US010755633B2

(12) United States Patent
Tang et al.

(10) Patent No.: US 10,755,633 B2
(45) Date of Patent: Aug. 25, 2020

(54) COMPENSATION METHOD AND COMPENSATION DEVICE, DISPLAY APPARATUS, DISPLAY METHOD AND STORAGE MEDIUM

(71) Applicants: CHENGDU BOE OPTOELECTRONICS TECHNOLOGY CO., LTD., Chengdu, Sichuan (CN); BOE TECHNOLOGY GROUP CO., LTD., Beijing (CN)

(72) Inventors: Wei Tang, Beijing (CN); Lixia Shen, Beijing (CN); Haoqing Guo, Beijing (CN)

(73) Assignees: CHENGDU BOE OPTOELECTRONICS TECHNOLOGY CO., Chengdu, Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/397,748

(22) Filed: Apr. 29, 2019

(65) Prior Publication Data

US 2020/0105190 A1 Apr. 2, 2020

(30) Foreign Application Priority Data

Sep. 27, 2018 (CN) ..... 2018 1 1133453

(51) Int. Cl.
*G09G 3/3225* (2016.01)

(52) U.S. Cl.
CPC ... *G09G 3/3225* (2013.01); *G09G 2320/0233* (2013.01); *G09G 2320/0257* (2013.01); *G09G 2320/045* (2013.01)

(58) Field of Classification Search
CPC ..... G09G 2320/0233; G09G 2320/257; G09G 2320/04; G09G 2320/041; G09G 2320/043; G09G 2320/045; G09G 2320/06; G09G 2320/062; G09G 2320/0626; G09G 2320/066; G09G 2320/0666; G09G 2320/0673; G09G 2320/0693; G09G 2320/103
See application file for complete search history.

(56) References Cited

U.S. PATENT DOCUMENTS 6,268,870 B1 * 7/2001 Kato ..... G06F 3/033 345/660
9,686,338 B1 * 6/2017 Farrell ..... H04L 65/80
2005/0018094 A1 * 1/2005 Suzuki ..... G09G 3/3611 348/790

(Continued)

*Primary Examiner* — Dong Hui Liang

(57) ABSTRACT

A compensation method of a display panel, a compensation device, a display method, a display apparatus and a storage medium. The compensation method of a display panel includes: obtaining an initial compensation parameter of each pixel of the display panel and an initial conversion range for performing a data conversion on the initial compensation parameter; optimizing the initial conversion range based on a compensation effect of a compensation parameter to obtain an optimized conversion range, where the compensation effect of the compensation parameter is obtained based on the initial conversion range; and obtaining an optimized compensation parameter of each pixel of the display panel based on the optimized conversion range.

20 Claims, 6 Drawing Sheets

(56) References Cited

U.S. PATENT DOCUMENTS

| | | | | |
|---|---|---|---|---|
| 2008/0238934 | A1* | 10/2008 | Daly | G09G 3/2007 345/617 |
| 2011/0057967 | A1* | 3/2011 | Adachi | G09G 3/2092 345/690 |
| 2012/0074851 | A1* | 3/2012 | Erinjippurath | G09G 3/20 315/158 |
| 2012/0075354 | A1* | 3/2012 | Su | G09G 5/10 345/690 |
| 2016/0163246 | A1* | 6/2016 | Lee | G09G 5/14 345/690 |
| 2018/0027149 | A1* | 1/2018 | Murase | H04N 5/23229 348/242 |
| 2018/0255207 | A1* | 9/2018 | Sato | H04N 9/74 |
| 2019/0191153 | A1* | 6/2019 | Speigle | H04N 17/04 |

* cited by examiner

COMPENSATION METHOD AND COMPENSATION DEVICE, DISPLAY APPARATUS, DISPLAY METHOD AND STORAGE MEDIUM

The present application claims priority to Chinese Patent Application No. 201811133453.6, filed on Sep. 27, 2018, and entitled: "Compensation Method and Compensation Device, Display Apparatus, Display method and Storage Medium", the disclosure of which is incorporated herein by reference in its entirety as part of the present application.

TECHNICAL FIELD

Embodiments of the present disclosure relate to a compensation method of a display panel, a compensation device a display method, a display apparatus and a storage medium.

BACKGROUND

Compared with a liquid crystal display (LCD), an organic light-emitting diode (OLED) display device has advantages such as high contrast ratio, ultra-thin and ultra-light, bendability, etc., and therefore, the OLED display device is increasingly applied in high-performance display. However, brightness uniformity and residual image are two main challenges the OLED display faces at present. In order to solve the technical problems of brightness uniformity and residual image in OLED, besides improvements of the production process, compensation techniques have also been proposed.

SUMMARY

At least one embodiment of the present disclosure provides a compensation method of a display panel, and the compensation method includes: obtaining an initial compensation parameter of each pixel of the display panel and an initial conversion range far performing a data conversion on the initial compensation parameter; optimizing the initial conversion range based on a compensation effect of a compensation parameter to obtain an optimized conversion range, wherein the compensation effect of the compensation parameter is obtained based on the initial conversion range; and obtaining an optimized compensation parameter of each pixel of the display panel based on the optimized conversion range.

For example, in the compensation method of a display panel provided by at least one embodiment of the present disclosure, the optimizing the initial conversion range based on the compensation effect of the compensation parameter includes: storing the initial compensation parameter in the display panel and performing the data conversion to obtain a converted compensation parameter, based on the initial conversion range; compensating for a display data signal of the display panel and obtaining a display compensation effect of the display panel, based on the converted compensation parameter; optimizing, based on the display compensation effect of the display panel and the initial compensation parameter of the display panel, the initial conversion range of the initial compensation parameter to obtain the optimized conversion range.

For example, in the compensation method of a display panel provided by at least one embodiment of the present disclosure, the optimizing, based on the display compensation effect of the display panel and the initial compensation parameter of the display panel, the initial conversion range of the initial compensation parameter includes: detecting, based on the obtained display compensation effect of the display panel, compensation precision and compensation strength of the display panel, and performing one of following operations: narrowing the initial conversion range of the initial compensation parameter to obtain the optimized conversion range, in a case where the compensation precision is insufficient; or expanding the initial conversion range of the initial compensation parameter to obtain the optimized conversion range, in a case where the compensation strength is insufficient.

For example, in the compensation method of a display panel provided by at least one embodiment of the present disclosure, the narrowing the initial conversion range of the initial compensation parameter to obtain the optimized conversion range, in a case where the compensation precision is insufficient includes: selecting a range smaller than the initial conversion range among a plurality of preset alternative conversion ranges, and the expanding the initial conversion range of the initial compensation parameter to obtain the optimized conversion range, in a case where the compensation strength is insufficient includes: selecting a range greater than the initial conversion range among a plurality of preset alternative conversion ranges.

For example, in the compensation method of a display panel provided by at least one embodiment of the present disclosure, the initial compensation parameter of each pixel is in at least one selected from a group consisting of: the initial conversion range and the optimized conversion range.

For example, the compensation method of a display panel provided by at least one embodiment of the present disclosure further includes: storing the optimized compensation parameter of each pixel in the display panel to compensate for a display data signal of the display panel by the display panel based on the optimized compensation parameter in a display operation.

For example, in the compensation method of a display panel provided by at least one embodiment of the present disclosure, the optimized compensation parameter of each pixel is stored in a lookup table of a controller of the display panel, and the display panel obtains from the lookup table an optimized compensation parameter corresponding to a current pixel in the display operation to obtain a display compensation data of the current pixel.

For example, in the compensation method of a display panel provided by at least one embodiment of the present disclosure, the display panel includes a plurality of display regions, the plurality of display regions includes a first display region, the initial compensation parameter includes a first initial compensation parameter corresponding to the first display region, the initial conversion range includes a first initial conversion range corresponding to the first display region, and the compensation method optimizes the first initial conversion range of the first display region, based on the first initial compensation parameter and a display compensation effect of the first display region.

For example, in the compensation method of a display panel provided by at least one embodiment of the present disclosure, the plurality of display regions further includes a second display region different from the first display region, the initial compensation parameter includes a second initial compensation parameter corresponding to the second display region, the initial conversion range includes a second initial conversion range corresponding to the second display region, and the compensation method further optimizes the second initial conversion range of the second display region, based on the second initial compensation parameter and a display compensation effect of the second display region.

For example, in the compensation method of a display panel provided by at least one embodiment of the present disclosure, the initial compensation parameter of each pixel of the display panel is a compensation parameter obtained based on obtained optical data of the display panel.

At least one embodiment of the present disclosure also provides a display method of a display panel, which includes: obtaining an optimized conversion range and an optimized compensation parameter of the display panel by the compensation method provided by any one of the embodiments of the present disclosure; compensating for a display data signal of the display panel based on the optimized compensation parameter; performing a display operation by using the compensated display data signal.

At least one embodiment of the present disclosure also provides a compensation device of a display panel, which includes: an obtaining circuit, configured to obtain an initial compensation parameter of each pixel of the display panel and an initial conversion range for performing a data conversion on the initial compensation parameter; an optimization circuit, configured to optimize the initial conversion range based on a compensation effect of a compensation parameter obtained based on the initial conversion range, to obtain an optimized conversion range; and a compensation circuit, configured to obtain an optimized compensation parameter of each pixel of the display panel based on the optimized conversion range.

At least one embodiment of the present disclosure also provides a compensation device of a display panel, which includes: a processor; a memory; and one or more computer program modules, wherein the one or more computer program modules are stored in the memory and are configured to be executed by the processor, and the one or more computer program modules include an instruction used for achieving the compensation method of a display panel provided by any one of the embodiments of the present disclosure.

At least one embodiment of the present disclosure also provides a display apparatus, which includes the compensation device of a display panel provided by any one of the embodiments of the present disclosure.

At least one embodiment of the present disclosure also provides a storage medium, storing a computer-readable instruction non-transitorily, which, when executed by a processing device, causes the compensation method of a display panel provided by any one of the embodiments of the present disclosure be performed.

BRIEF DESCRIPTION OF THE DRAWINGS

In order to clearly illustrate the technical solutions of the embodiments of the present disclosure, the drawings of the embodiments will be briefly described in the following; it is obvious that the described drawings are only related to some embodiments of the disclosure and thus are not limitative to the present disclosure.

DETAILED DESCRIPTION

Figure 1:
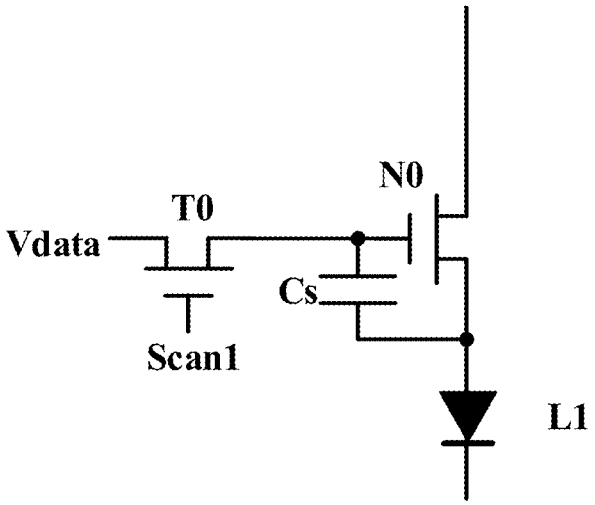
FIG. 1 is a schematic diagram of a 2T1C pixel circuit.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Hereinafter, various embodiments of the present disclosure will be described in detail with reference to the accompanying drawings. It should be noted that in the accompanying drawings, the same reference numerals are assigned to components with essentially the same or similar structures and functions, and repeated descriptions thereof will be omitted.

Typically, OLED display panels include an AMOLED (Active Matrix Organic Light Emitting Diode) display panel and a PMOLED (Passive Matrix Organic Light Emitting Diode) display panel. The OLED display panels are widely used in different fields. For example, in a commercial field, the OLED display panels may be applied in a POS (Point Of Sale) machine, an ATM (Automatic Teller Machine), a copier, a game machine, etc.; in a communication field, the OLED display panels may be applied in a mobile phone, a mobile network terminal, etc.; in a computer field, the OLED display panels may be applied in a PDA (Personal Digital Assistant, PDA), a commercial PC (personal computer) and a home PC, notebook computer, etc.; in a consumer electronics field, the OLED display panels may be applied in an audio equipment, a digital camera, a portable DVD (Digital Video Disc), etc.; in an industrial application field, the OLED display panels may be applied in instruments; and in a transportation field, the OLED display panels may be applied in a GPS (Global Positioning System) device, an aircraft instrument, etc.

A basic pixel circuit used in an AMOLED display device is usually a 2T1C pixel circuit, that is, using two thin film transistors (TFTs) and one storage capacitor Cs to realize a basic function of driving an light-emitting element L1 (for example, OLED) to emit light. As shown in FIG. 1, a 2T1C pixel circuit includes a switching transistor T0, a driving transistor N0, and a storage capacitor Cs. The switching transistor T0 is turned on/off by a scan signal, thereby charging the storage capacitor Cs with a voltage corresponding to display data, thereby controlling a conduction degree of the driving transistor N0 by the data voltage stored by the storage capacitor Cs, and controlling a current flowing through the OLED and adjusting brightness of the OLED.

A low-temperature poly-crystalline silicon thin film transistor (LTPS TFT) is usually used in small and medium-sized OLED display panels, while an oxide thin film transistor is often used in large-sized OLED display panels. This is because that the LTPS TFT has a higher mobility, a smaller occupied area, and is more suitable for high PPI (Pixels Per Inch) applications; the oxide thin film transistor has better uniformity, the manufacturing process thereof is compatible with that of a general amorphous Silicon thin film transistor (a-Si TFT), so the oxide thin film transistor is more suitable for production on a production line.

For OLED pixel circuits used in small and medium-sized display panels, due to limitations of a crystallization process for forming a poly-crystalline silicon active layer of a TFT, LIPS TFTs at different locations often exhibit non-uniformity in electrical parameters such as threshold voltage, mobility, etc. This non-uniformity may be transformed into a current difference and a brightness difference in the OLED display panel, which may be perceived by human eyes (i.e., Mura phenomenon). For an OLED pixel circuit used in a large-sized display panel, the oxide thin film transistor has a good process uniformity, but the threshold voltage of the oxide thin film transistor may drift under a long-time pressure and high temperature environment. Due to differences in displayed pictures, threshold shifts of the TFTs in different parts of the panel are different, which cause a difference of display brightness. This difference is related to a previously displayed image, and therefore, it is often presented as an afterimage phenomenon, also generally referred to as a ghost image.

In current manufacturing processes, both the LTPS TFT and the oxide thin film transistor have problems regarding uniformity or stability, and the brightness of the OLED itself will gradually attenuate with an increase of lighting time. These problems are difficult to completely overcome through the processes, so various compensation techniques may be used to solve these problems.

At present, the technical problems regarding brightness uniformity and afterimage of the OLED display panel may be solved by an internal compensation technique or an external compensation technique. The internal compensation technique refers to a method of compensation using a compensation sub-circuit formed by TFTs inside a pixel. The external compensation technique refers to a method of sensing electrical or optical characteristics of a pixel through an external driving circuit or device and then compensating. Due to a complicated design and a difficult process of an AMOLED circuit, when performing a high-resolution (QHD and above) display, if only an internal compensation is performed for the display panel, it will be difficult to eliminate the Mura phenomenon of the display screen. Therefore, in order to improve the product yield, reduce the occurrence of the Mura phenomenon and enhance comprehensive competitiveness of products in the market, on the basis of the internal compensation, an external compensation will be used to improve product completeness and product yield.

Figure 2:
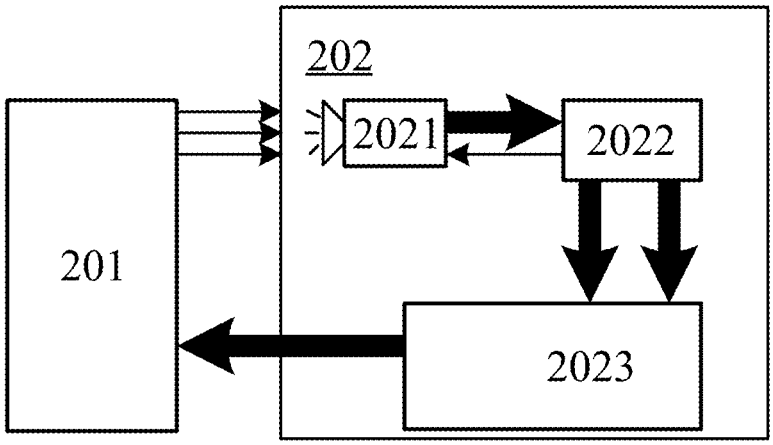
FIG. 2 is a schematic diagram of an external optical compensation system.

FIG. 2 shows a schematic diagram of an external optical compensation (Demura) system. As shown in FIG. 2, the optical compensation system includes an OLED display panel 201 being detected and an optical compensation device 202, and the optical compensation device 202 includes: a camera 2021, a data processing unit 2022, a control unit 2023, etc., which are in signal connection with each other in a wired or wireless manner.

For example, the OLED display panel is taken as an example. In addition to an pixel array, the OLED display panel may further include a data decoding circuit, a timing controller (T-con), a gate driving circuit, a data driving circuit, and a storage device (for example, a flash memory), etc. The data decoding circuit receives a display input signal from a signal source (such as a set-top box, the Internet, an external storage device, etc.) and decodes the display input signal to obtain a display data signal; the timing controller outputs a timing signal to control the gate driving circuit, the data driving circuit, and the like to work synchronously, and may perform gamma tuning to the display data signal, and input the processed display data signal to the data driving circuit for a display operation. For example, the timing controller, before performing gamma tuning to the display data signal, may further perform a compensation processing on the display data signal, for example, reading a pre-stored pixel compensation parameter from the storage device, and further processing the display data signal by using the pixel compensation parameter to obtain the compensated display data signal, and after completing the compensation processing and gamma tuning, outputting the display data signal to the data driving circuit for the display operation. Alternatively, the display panel may also include an independent gamma circuit, which performs gamma tuning and the compensation processing on the display data signal under the control of the timing controller.

For example, in at least one example, the optical compensation device 202 may include a processor, and a memory configured to store computer program instructions, wherein the computer program instructions are adapted to be loaded and executed by a processor to perform an optical compensation method for a display panel (detailed description will be provided below), and to implement functions of various modules (for example, the data processing unit 2022 and the control unit 2023) in FIG. 2. The processor may be any appropriate processor, for example, the processor may be implemented as a central processing unit, a microprocessor or an embedded processor, etc., and may adopt an architecture such as X86 or ARM, etc.; the memory may be any appropriate storage device, such as a non-volatile storage device, including but not limited to a magnetic storage device, a semiconductor storage device and an optical storage device, etc., and may be arranged as a single storage device, a storage device array, or a distributed storage device, the embodiments of the present disclosure has no limitation in this aspect.

The data processing unit 2022 of the optical compensation device 202 sends a test image to the control unit 2023, and the control unit 2023 processes the test image and sends the processed test image to the OLED display panel 201 being tested to display a required picture for testing. In addition, the data processing unit 2022 further obtains a captured image of the actual display picture of the OLED display panel from the camera 2021, compares the captured image with the test image to obtain the pixel compensation parameter, and inputs the pixel compensation parameter into the storage device of the OLED display panel 201 for storing, so that the pixel compensation parameter may be used in the compensation processing during the subsequent display operation of the OLED display panel.

For example, the camera 2021 is configured to capture luminance information of each pixel of the OLED display panel 201 being tested at a selected grayscale. For example, the camera 2021 is, for example, a CCD camera with high resolution and high precision. It should be noted that the camera 2021 includes but is not limited to a CCD (Charge Coupled Device) camera and a CMOS (Complementary Metal Oxide Semiconductor) camera.

For example, in at least one example, to obtain the pixel compensation parameter, the data processing unit 2022 is configured to process a measured grayscale response curve for each pixel, and then according to an ideal grayscale response curve, by using a method of adjusting the grayscale, for example, using a polynomial to fit the compensated gray scale with the input gray scale, obtain polynomial coefficients for compensation, and to write the polynomial coefficients for compensation into the storage device of the display panel 201 under the control of the control unit 2023.

Thereafter, when the OLED display panel 201 is used as a product in a normal display operation, the control unit (for example, the timing controller T-con) of the display panel 201 reads these pre-stored polynomial coefficients for pixel compensation from the storage device of the display panel 201, and processes these pre-stored polynomial coefficients to obtain a tuned grayscale corresponding to each grayscale of each pixel, thereby realizing real-time compensation for grayscale accuracy of each pixel and achieving brightness uniformity, and finally improving display uniformity of the entire OLED display panel 201. For example, the polynomial of the optical compensation algorithm may be expressed as:

$$Y=aX+b \tag{1}$$

where Y represents a compensated pixel voltage, X represents an initial pixel voltage of the display panel, a represents a gain, and b represents an offset.

For example, a and b in the above formula are the coefficients of the polynomial. Similarly, grayscale uniformity compensation may be performed on each pixel of the OLED display panel. The grayscale compensation is taken as an example for the following description, but the embodiments of the present disclosure do not limit this.

In a process of compensating for the display data, it is necessary to perform a data conversion on the compensation parameter (for example, the compensation polynomial coefficients a, b described above). For example, when the compensation parameters are pre-stored in the memory (having a fixed number of bits, such as 8 bits, 10 bits, etc.) of the display panel, the compensation parameters are required to be converted into a binary form that is adaptable for the memory. The binary form after the conversion only corresponds to a value of the actual compensation parameter, rather than the actual compensation parameter, and therefore, when the display data of the display panel is required to be compensated by using the compensation parameter, the compensation parameter stored in the binary form is required to be converted into the actual compensation parameter, so as to calculate the compensated display data of the display panel. For example, the actual compensation parameter is substituted into formula (1) described above to calculate the compensated pixel voltage Y using the initial pixel voltage X.

For example, an 8-bit memory is taken as an example for the following description. The 8-bit memory may store 256 values (i.e. the 8th power of 2). Therefore, for example, when a data conversion range is 0 to 127, the data conversion step is 0.5, and a value in the initial compensation parameter, for example, 0.8, when being data converted and stored, may be stored as 1 (for convenience of presentation, here the actual compensation parameter corresponding to the binary value is described, that is, the actual compensation parameter obtained after the data conversion on the compensation parameter stored in the binary form in the memory); when the data conversion range is 0~63, the data conversion step is 0.25, the initial compensation parameter 0.8 may be stored as 0.75 when being stored. It may be figured out that when the data conversion range is 0~63 the stored value is closer to the initial compensation parameter; accordingly, when the data conversion range is smaller, the data conversion step will become smaller. Therefore, the data conversion range used in the data conversion has a certain influence on the actual compensation parameters obtained after the data conversion operation on the initial compensation parameter, and the actual compensation parameter directly affects the compensation for the display data of the display panel, so that the data conversion range used in the data conversion has a direct influence on the display compensation effect (for example, compensation precision and compensation strength) of the display panel.

Figure 3:
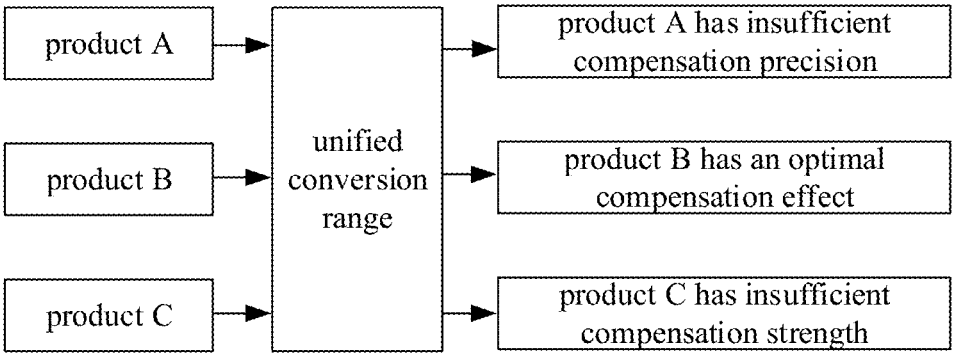
FIG. 3 is a schematic diagram of compensation effects of a scheme with a unified parameter on various products.

In addition, for products of different specifications or even products of different batches of a same specification, there may be different requirements for the setting of the compensation parameter due to different technological levels. FIG. 3 is a schematic diagram of compensation effects of a scheme with a unified conversion range (i.e., products of different specifications adopt the same data conversion range) on various products. For example, as shown in FIG. 3, in a case where product B reaches an optimal compensation effect by using the compensation parameter obtained through the conversion range, product A may have a problem of an insufficient compensation precision after being compensated by using the compensation parameter obtained through the conversion range, that is, the display image in the display panel has phenomena such as fine streaks, etc., and product C may have a problem of an insufficient compensation strength after being compensated by using the compensation parameter obtained through the conversion range, that is, the display image in the display panel thereof still has the Mura phenomenon. Therefore, it is difficult to meet the requirements of all products, and to enable all products to achieve an optimal compensation effect at the same time, by setting a uniform conversion range.

At least one embodiment of the present disclosure provides a compensation method of a display panel, which includes: obtaining an initial compensation parameter of each pixel of the display panel and an initial conversion range for performing a data conversion on the initial compensation parameter; optimizing the initial conversion range based on a compensation effect of a compensation parameter obtained based on the initial conversion range, to obtain an optimized conversion range; and obtaining an optimized compensation parameter of each pixel of the display panel based on the optimized conversion range. At least one embodiment of the present disclosure also provides a compensation device, a display method, a display method of a display panel, a display apparatus and a storage medium corresponding to the compensation method of the display panel described above.

The compensation method of the display panel provided by the above embodiments of the present disclosure may flexibly select the data conversion range according to the characteristics of different products, thereby meeting the actual requirements of different products, enabling each product to achieve an optimal compensation effect and improving the display quality of the display panel and the production yield of the production line.

Embodiments of the present disclosure will be described in detail below with reference to the accompanying drawings. It should be noted that the same reference numerals in different accompanying drawings will be used to refer to the same elements that have been described.

Figure 4:
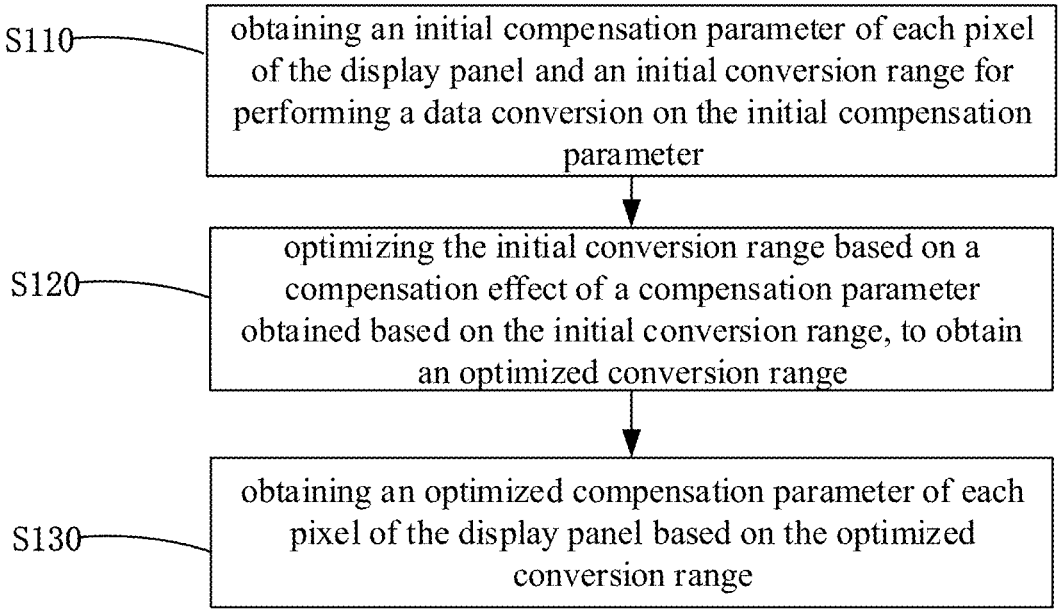
FIG. 4 is a flowchart of a compensation method of a display panel provided by at least one embodiment of the present disclosure.

FIG. 4 is a flowchart of a compensation method of a display panel provided by at least one embodiment of the present disclosure. For example, the display panel may be an organic light emitting diode display panel or another type of display panel, etc., which is not limited in the embodiment of the present disclosure. The organic light emitting diode display panel is taken as an example for the following description. For example, the compensation method may be implemented at least partially in software and loaded and executed by a processor in the display panel, or at least partially implemented in hardware or firmware, to solve the problem of an unsatisfactory compensation effect described above. For example, the compensation method shown in FIG. 4 may be performed in real time in the display operation of the display panel, so that the display data of the display panel may be compensated in real time, and the display uniformity of the display panel and the display quality of the display panel may be improved.

Hereinafter, the compensation method provided by the embodiment of the present disclosure will be described with reference to FIG. 4. As shown in FIG. 4, the compensation method includes steps S110 to S130.

Step S110: obtaining an initial compensation parameter of each pixel of the display panel and an initial conversion range for performing a data conversion on the initial compensation parameter.

Step S120: optimizing the initial conversion range based on a compensation effect of a compensation parameter obtained based on the initial conversion range, to obtain an optimized conversion range.

Step S130: obtaining an optimized compensation parameter of each pixel of the display panel based on the optimized conversion range.

For step S110, for example, the initial compensation parameter of each pixel of the display panel may be a compensation parameter obtained based on obtained optical data of the display panel.

As shown in FIG. 2, in a process of obtaining the initial compensation parameter, a high-resolution and high-precision camera 2021 may be used to acquire a test image displayed by an OLED display panel 201, and the camera 2021 transmits data of the test image to a data processing unit 2022 after capturing the test image. The data processing unit 2022 analyzes grayscale/brightness distribution characteristics of each pixel of the display panel according to the display data of the acquired test image, and identifies a grayscale/brightness difference (namely Mura) between each pixel of the display panel and each pixel in the target test image according to a related algorithm, that is, the optical data of the display panel. The related algorithm includes but is not limited to an optical measurement method. Then, the data processing unit 2022 calculates the compensation parameter of the display panel according to the Mura data of each pixel of the display panel and a corresponding compensation algorithm, and the compensation parameter is then converted into a binary form by the data conversion operation in the above steps according to the initial conversion range and stored in the memory of the display panel for being used in a normal display operation, therefore, the unsaved compensation parameter is referred to as the initial compensation parameter. The compensation algorithm includes but is not limited to any known Demura algorithm. For example, the initial compensation parameter of the display panel includes the gain a and the offset b in the above formula (1).

For example, after determining the initial compensation parameter of each pixel of the display panel, the initial conversion range for performing a data conversion on the initial compensation parameter may be set according to the obtained initial compensation parameter. For example, the initial conversion range may be set to include the initial compensation parameters of all pixels, and the specific size thereof may be set empirically, which is not limited by the embodiment of the present disclosure. For example, the data conversion includes at least: firstly, converting the initial compensation parameter into a binary form to be stored in the memory of the display panel based on the initial conversion range; and then, based on the initial conversion range, converting the compensation parameter of the binary form stored in the memory to the actual compensation parameter, which is substituted into the above formula (1) to calculate the compensated display data. For example, the actual compensation parameter may be the same or substantially the same as the initial compensation parameter, or may be different from the initial compensation parameter.

For example, the initial compensation parameter may be measured and calculated before the compensation operation. For example, the initial compensation parameter may be measured and calculated before the OLED display panel leaves the factory, or may be measured and calculated after the OLED display panel has left the factory. For example, the initial compensation parameter is stored in the binary form in the memory of the OLED display panel by the data conversion operation described above, and the OLED display panel may read the initial compensation parameter from the memory and convert the initial compensation parameter into the actual compensation parameter when needed. In addition to storing data for computing and data generated by computing, the memory may include one or more computer program products, and the computer program products include various forms of computer readable storage media, such as a volatile memory and/or a non-volatile memory.

For example, an obtaining circuit may be provided, and the initial compensation parameter of each pixel of the display panel and the initial conversion range for performing a data conversion on the initial compensation parameter may be obtained by the obtaining circuit. For example, the initial compensation parameter of each pixel of the display panel and the initial conversion range for performing a data conversion on the initial compensation parameter may be obtained by a central processing unit (CPU), a graphics processing unit (GPU), a field programmable gate array (FPGA), or other form of processing unit having data processing capabilities and/or instruction execution capabilities. The processing unit may be a general purpose processor or a dedicated processor, and may be an processor based on X86 or ARM architecture, etc. For example, the obtaining circuit is disposed in a control device (controller) of the display panel.

For step S120, the display compensation effect of the display panel obtained by using the compensation parameter obtained based on the initial conversion range is detected. If the display compensation effect of the display panel reaches an optimal compensation effect, the initial conversion range may not be optimized; and if the display compensation effect of the display panel has a problem of insufficient compensation precision or insufficient compensation strength, such as a fine streak, etc., the initial conversion range requires being optimized. A specific optimization process will be described in detail with reference to the example shown in FIG. 5, and details are not be described herein again.

For example, when the initial conversion range is optimized, a range smaller or greater than the initial conversion range may be selected as the optimized conversion range among a plurality of preset alternative conversion ranges. A specific selection method will be described in detail with reference to the example shown in FIG. 6, and details are not described herein again. For example, the plurality of alternative conversion ranges may include a range that is greater or smaller than the initial conversion range. For example, the plurality of alternative conversion ranges and the optimized conversion range may be set to include the initial compensation parameters of all pixels, and specific sizes thereof may also be set empirically, which are not limited by the embodiment of the present disclosure.

In this step, by adopting the compensation method which sets a plurality of range, the data conversion of the compensation parameter may be more adaptive in a storing process, and different conversion ranges may be selected according to the characteristics of different products to optimize the compensation effect of the Demura algorithm, and at the same time, to improve the display quality of, for example, individual OLED display panels in different batches, and to improve the production yield of the production line.

For example, an optimization circuit may be provided, and the initial conversion range may be optimized by the optimization circuit to obtain the optimized conversion range. For example, the initial conversion range may be optimized by a central processing unit (CPU), a graphics processing unit (GPU), a field programmable gate array (FPGA), or other form of processing unit having data processing capabilities and/or instruction execution capabilities.

For step S130, for example, the compensation parameter converted based on the optimized conversion range is referred to as the optimized compensation parameter. The compensation method, for example, further includes: storing the optimized compensation parameter of each pixel in the display panel to compensate for a display data signal of the display panel by the display panel based on the optimized compensation parameter in a display operation.

For example, the data conversion operation based on the optimized conversion range is as described above, that is, storing the initial conversion parameter of each pixel in binary form in the display panel based on the optimized conversion range, and upon compensating for the display data of the display panel, reading a corresponding compensation parameter in the memory by the controller, and performing a data conversion operation on the corresponding compensation parameter based on the optimized conversion range to obtain the optimized compensation parameter, and substituting the optimized compensation parameter into the above formula (1) to obtain the compensated display data which is used to compensate for the display data signal of the display panel.

For example, the initial compensation parameter may be obtained in real time through the obtaining approach in step S110, that is, the initial compensation parameter for data conversion based on the optimized conversion range may be re-obtained, and therefore, no additional storage space is required to store the initial compensation parameter of the display panel. For example, the initial compensation parameters of the display panel obtained each time are substantially the same.

For example, when the controller reads the compensation parameter, the optimized compensation parameter corresponding to each pixel may be obtained by means of a lookup table. For example, the controller reads the optimized compensation parameter of the corresponding pixel from the memory into the lookup table of the controller, so that the display panel may obtain, in the display operation, the optimized compensation parameter corresponding to the current pixel from the lookup table, and then compensate for the display data of the current pixel based on the compensation parameter of the current pixel obtained from the lookup table (for example, by using the above formula (1)), so as to obtain a display compensation data of the current pixel.

For example, a compensation circuit may be provided, and the optimized compensation parameter of each pixel of the display panel may be obtained by the compensation circuit. For example, the optimized compensation parameter of each pixel of the display panel may be obtained by a central processing unit (CPU), a graphics processing unit (CPU), a field programmable gate array (FPGA), or other form of processing unit having data processing capabilities and/or instruction execution capabilities.

The compensation method of the display panel provided by the above embodiments of the present disclosure may flexibly select the data conversion range according to the characteristics of different products, thereby meeting the actual requirements of different products, enabling each product to achieve an optimal compensation effect and improving the display quality of the display panel and the production yield of the production line.

Figure 5:
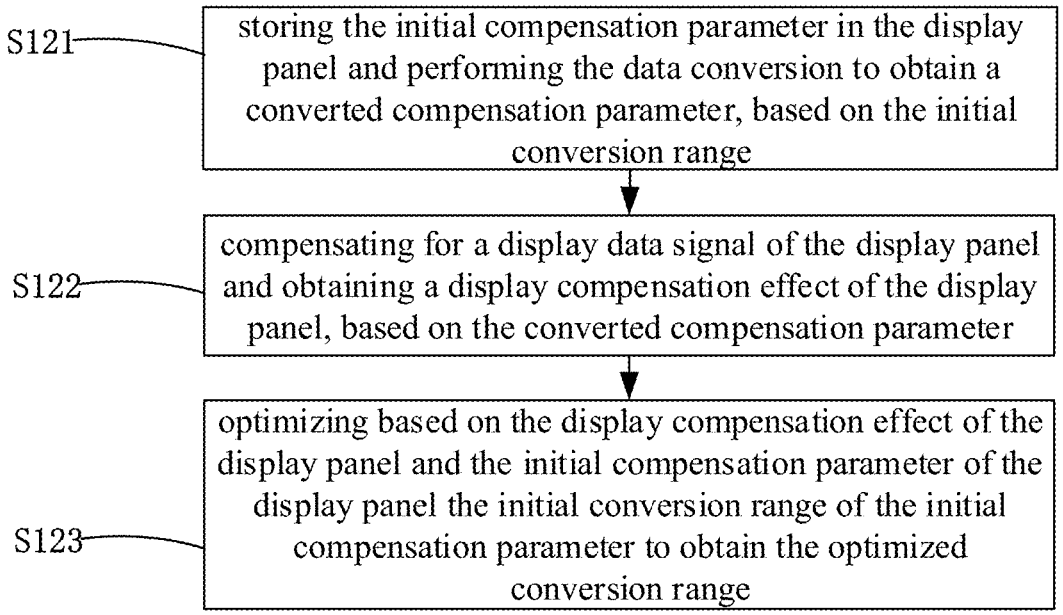
FIG. 5 is a flowchart of a method of optimizing an initial conversion range provided by at least one embodiment of the present disclosure.

FIG. 5 is a flowchart of a method of optimizing an initial conversion range provided by at least one embodiment of the present disclosure. That is, FIG. 5 is a flowchart of an example of step S120 shown in FIG. 4. As shown in FIG. 5, the compensation method of optimizing the initial conversion range includes steps S121 to S123.

Step S121: storing the initial compensation parameter in the display panel and performing the data conversion to obtain a converted compensation parameter, based on the initial conversion range.

In this step, firstly, the initial compensation parameter is converted into a binary form based on the initial conversion range so as to be stored in the memory of the display panel; then, based on the initial conversion range, the compensation parameter in binary form stored in the memory is converted into the actual compensation parameter, that is, the converted compensation parameter, which is substituted into the above formula (1) to calculate the compensated display data.

For example, the initial compensation parameter is stored in a memory of a fixed number of bits (for example, 8 bits, 10 bits, etc.) after the data conversion. An 8-bit memory is taken as an example for the following description, which is not limited in the embodiment of the present disclosure. For example, the initial conversion range of the initial compensation parameter (for example, the offset b) is −64~64, then, when a data conversion is performed based on the initial conversion range, the value in the initial conversion range −64~64 will be sequentially stored in the memory of the display panel with a storing step of 0.5. For example, the binary value 255 in the memory represents 64 in the initial conversion range, and the binary value 0 in the memory represents −64 in the initial conversion range.

For example, when the stored compensation parameter is used to compensate for the display data, it is necessary to convert a value stored in the display panel (for example, 0 to 255) into an actual compensation parameter value (for example, a value in −64 to 64), so that the actual compensation parameter value (i.e., the converted compensation parameter) is substituted into the above formula (1) for compensation calculation of the display data. For example, the converted compensation parameter includes −64, −63.5 . . . 63, 63.5, and 64.

It should be noted that a conversion process of the gain a included in the initial compensation parameter is similar to the conversion process of the offset b, and details are not be described here again.

Step S122: compensating for a display data signal of the display panel and obtaining a display compensation effect of the display panel, based on the converted compensation parameter.

For example, values corresponding to each pixel in the converted compensation parameter (for example, the gain a, and the offset h including −64, −63.5 . . . 63, 63.5, and 64) obtained in step S121 are substituted into the above formula (1), to calculate the compensated pixel voltage of each pixel, respectively, thereby compensating for the display data signal of the display panel. For example, in compensating for a certain pixel, the actual compensation parameter corresponding to the pixel is called by the controller to be substituted into the above formula (1), so as to obtain the compensated pixel voltage for the pixel.

For example, the compensated image displayed by the OLED display panel 201 is acquired manually or by the high-precision camera 2021 shown in FIG. 2, to analyze and obtain the display compensation effect of the display panel.

Step S123: optimizing based on the display compensation effect of the display panel and the initial compensation parameter of the display panel the initial conversion range of the initial compensation parameter to obtain the optimized conversion range.

Figure 6:
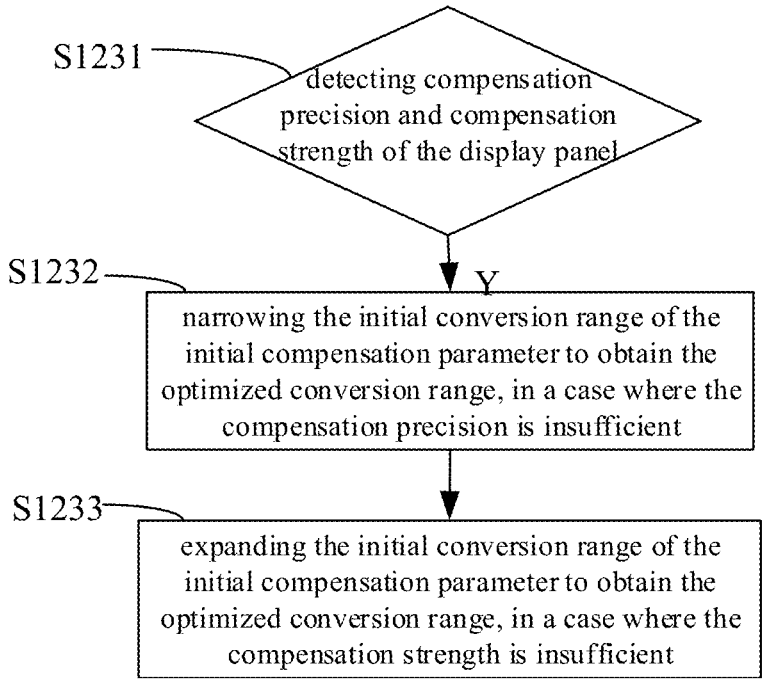
FIG. 6 is a flowchart of improving compensation precision and compensation strength provided by at least one embodiment of the present disclosure.
Figure 7:
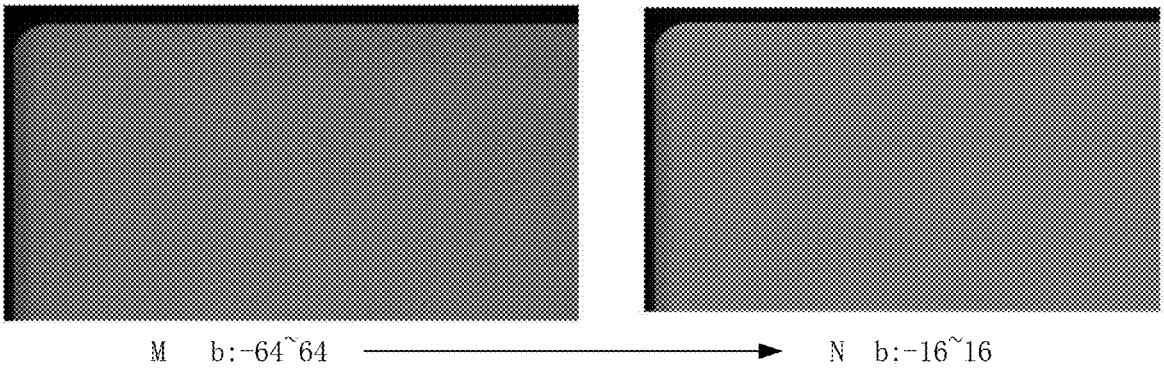
FIG. 7 is a diagram of an example of improving compensation precision provided by at least one embodiment of the present disclosure.

If the display compensation effect of the display panel reaches an optimal compensation effect, the initial conversion range may not be optimized; and if the display compensation effect of the display panel is unsatisfactory, for example, as shown by M in FIG. 7, the display image in the display panel has phenomena such as a fine streak, etc., that is, there exists a problem of insufficient compensation precision for the display panel, the initial conversion range requires to be optimized. For example, if there still exists a Mura phenomenon in the display image in the display panel, that is, there exists a problem of insufficient compensation strength, the initial conversion range also needs to be optimized. A specific optimization process will be described in detail in the example shown in FIG. 6, and details are not be described herein again.

FIG. 6 is a flowchart of improving compensation precision and compensation strength provided by at least one embodiment of the present disclosure, and FIG. 7 is a diagram of an example of improving compensation precision provided by at least one embodiment of the present disclosure. That is, FIG. 6 is a flowchart of an example of step S123 shown in FIG. 5. As shown in FIG. 6, the compensation method of improving compensation precision and compensation strength includes steps S1231 to S1233.

Step S1231: detecting compensation precision and compensation strength of the display panel.

For example, as shown by M in FIG. 7, if a phenomenon such as a fine streak appears in the display panel, there exists a problem that the compensation precision of the display panel is insufficient. If a Mum phenomenon still exists in the display panel, there exists a problem that the compensation strength of the display panel is insufficient. Of course, other phenomenon of the poor compensation effect may also be included, which is not limited by the embodiment of the present disclosure.

For example, compensation precision and compensation strength of the display panel are detected based on the obtained display compensation effect of the display panel, and one of following steps S1232 to S1233 is performed.

Step S1232: narrowing the initial conversion range of the initial compensation parameter to obtain the optimized conversion range, in a case where the compensation precision is insufficient.

For example, narrowing the initial conversion range of the initial compensation parameter may reduce the conversion step during the data conversion, so that the converted compensation parameter is closer to the initial compensation parameter before conversion, thereby improving the compensation precision of the display panel. For example, the optimized conversion range is a range smaller than the initial conversion range and selected among a plurality of preset alternative conversion ranges. For example, the alternative conversion ranges may include −128~128, −48~48, −32~32, −16~16, etc. For example, the optimized conversion range may still include the initial compensation parameters of individual pixels. Of course, the compensation parameters at some edges may be outside the optimized conversion range, and in compensating for the corresponding pixels, a maximum or minimum value of the optimized conversion range may be used, which is not limited by the embodiment of the present disclosure.

For example, in step S121, when the initial conversion range is −64 to 64, the conversion step is 0.5, and the compensation effect thereof is as shown by M in FIG. 7, where fine streaks appear in the display image of the display panel. When the initial conversion range is narrowed to −32~32 (i.e., the optimized conversion range), the conversion step becomes 0.25. For example, the converted compensation parameter, that is, the optimized compensation parameter includes −32, −31.25 . . . 31, 31.25, 31.5, 31.75, and 32. It may be figured out that compared with the converted compensation parameter obtained based on the initial conversion range of −64~64, the optimized compensation parameter obtained based on the optimized conversion range −32~32 has higher precision. As shown by N in FIG. 7, applying the optimized compensation parameters obtained based on the optimized conversion range −32~32 to compensate for the display panel, may well solve the phenomenon of fine streaks.

Step S1233: expanding the initial conversion range of the initial compensation parameter to obtain the optimized conversion range, in a case where the compensation strength is insufficient.

For example, expanding the initial conversion range of the initial compensation parameter may increase the data conversion step, thereby improving the compensation strength of the display panel. It should be noted that the conversion principle of this step is similar to that of step S1232, and details are not described here again.

By adopting the compensation method which sets a plurality of ranges, the data conversion of the compensation parameter may be more adaptive in a storing process, and different conversion ranges may be selected according to the characteristics of different products to optimize the compensation effect of the Demura algorithm, and at the same time, to improve the display quality of, for example, individual OLED display panels in different batches, and to improve the production yield of the production line.

Figure 8:
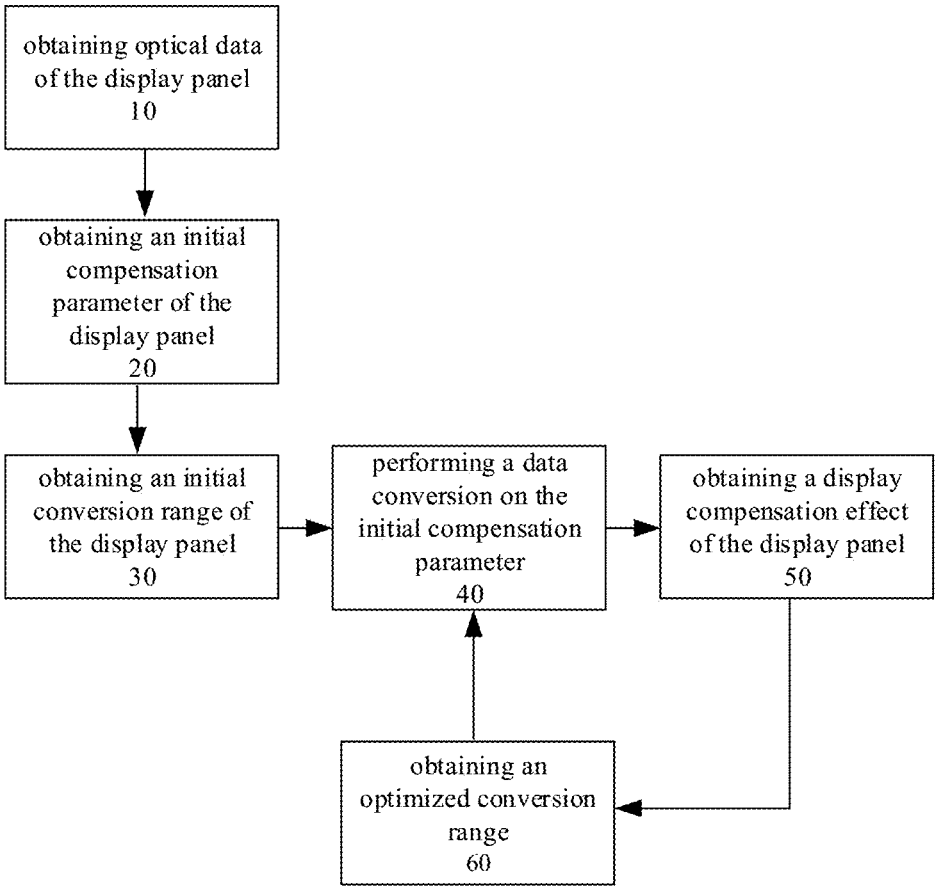
FIG. 8 is a flowchart of another compensation method of a display panel provided by at least one embodiment of the present disclosure.

FIG. 8 is a flowchart of another compensation method of a display panel provided by at least one embodiment of the present disclosure. As shown in FIG. 8, the compensation method includes steps S10 to S60.

Step S10: obtaining optical data of the display panel.

For example, a test image displayed by the OLED display panel 201 is acquired by the camera 2021 shown in FIG. 2, and the camera 2021 transmits data of the test image to a data processing unit 2022 after capturing the test image. The data processing unit 2022 analyzes grayscale/brightness distribution characteristics of each pixel of the display panel according to the display data of the acquired test image, and identifies a grayscale/brightness difference (namely Mura) between each pixel of the display panel and each pixel in the target test image according to a related algorithm, that is, the optical data of the display panel.

Step S20: obtaining an initial compensation parameter of the display panel.

For example, a compensation parameter of the display panel is calculated according to the optical data obtained in step S10 and a corresponding optical compensation algorithm, and the compensation parameter is referred to as the initial compensation parameter.

Step S30: obtaining an initial conversion range of the display panel.

For example, after determining the initial compensation parameter of each pixel of the display panel, the initial conversion range for performing a data conversion on the initial compensation parameter may be set according to the obtained initial compensation parameter. For example, the initial conversion range may be set to include the initial compensation parameters of all pixels, and a specific size thereof may be set empirically, which is not limited by the embodiment of the present disclosure.

Step S40: performing a data conversion on the initial compensation parameter.

For example, the data conversion operation includes at least: firstly, converting the initial compensation parameter into a binary form so as to be stored in a memory of the display panel based on the initial conversion range; and then, based on the initial conversion range, converting the compensation parameter in binary form stored in the memory to an actual compensation parameter, that is, a converted compensation parameter, which is substituted into the above formula (1) to calculate a compensated display data.

Step S50: obtaining a display compensation effect of the display panel.

The display data obtained in step S40 is inputted to the display panel for display. For example, the compensated image displayed by the OLED display panel 201 is acquired manually or by the high-precision camera 2021 shown in FIG. 2, to analyze and obtain the display compensation effect of the display panel. The display compensation effect of the display panel includes, for example, compensation precision and compensation strength for the display panel, etc.

Step S60: obtaining an optimized conversion range.

For example, based on the display compensation effect of the display panel and the initial compensation parameter of the display panel, the initial conversion range of the initial compensation parameter is optimized to obtain the optimized conversion range. A specific operation process may refer to steps S1231 to S1233 included in the example shown in FIG. 6, and details are not described here again.

After the optimized Conversion range is obtained, step S40 and step S50 are performed based on the optimized conversion range until the display compensation effect of the display panel reaches an optimal compensation effect.

It should be noted that, in at least one embodiment of the present disclosure, the display panel involved may include a plurality of display regions. In the compensation method provided by at least one embodiment of the present disclosure, accordingly, the initial compensation parameter, the initial conversion range, the optimized conversion range, and the optimized compensation parameter correspond to at least one display region, and a display data signal of at least one display region is compensated for based on the optimized compensation parameter. For example, optimized compensation parameters of the plurality of display regions are respectively obtained, and display data signals of the plurality of display regions are respectively compensated.

For example, the plurality of display regions comprises a first display region, the initial compensation parameter includes a first initial compensation parameter corresponding to the first display region, the initial conversion range includes a first initial conversion range corresponding to the first display region, and the compensation method optimizes the first initial conversion range of the first display region based on the first initial compensation parameter and a display compensation effect of the first display region.

The plurality of display regions further includes a second display region different from the first display region, the initial compensation parameter includes a second initial compensation parameter corresponding to the second display region, the initial conversion range includes a second initial conversion range corresponding to the second display region, and the compensation method further optimizes the second initial conversion range of the second display region based on the second initial compensation parameter and a display compensation effect of the second display region.

It should be noted that, in the embodiments of the present disclosure, the flow of the compensation method may include more or less operations, and these operations may be performed sequentially or in parallel. Although the flow of the compensation method described above includes a plurality of operations presented in a specific order, it should be clearly understood that the order of the plurality of operations is not limited. The compensation method described above may be performed once or may be performed a plurality of times according to predetermined conditions.

Figure 9:
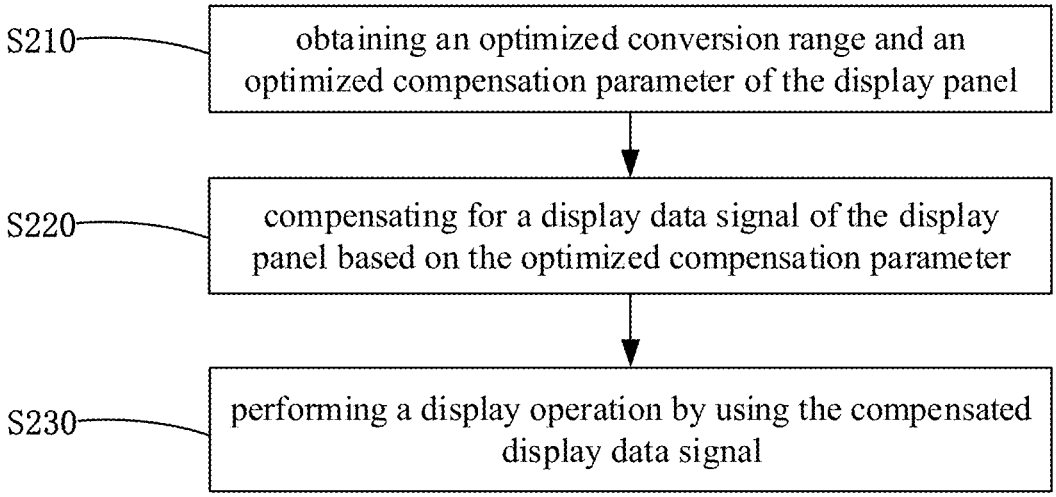
FIG. 9 is a flowchart of a display method of a display panel provided by at least one embodiment of the present disclosure.

At least one embodiment of the present disclosure also provides a display method of a display panel, to perform a compensation operation by using compensated display data. FIG. 9 is a flowchart of a display method of a display panel provided by at least one embodiment of the present disclosure. As shown in FIG. 9, the display method includes steps S210 to S230.

Step S210: obtaining an optimized conversion range and an optimized compensation parameter of the display panel.

For example, the optimized conversion range and the optimized compensation parameter of the display panel may be obtained by using the compensation method provided by any one of the embodiments of the present disclosure. A specific implementation may refer to the description of the examples shown in FIG. 4 to FIG. 7, and details are not described here again.

Step S220: compensating for a display data signal of the display panel based on the optimized compensation parameter.

For example, a compensated pixel voltage of each pixel in the display panel, that is, the compensated display data signal, may be calculated by the above formula (1). In the calculation process, the gain a and the offset b in the above formula (1) use optimized values, respectively.

Step S230: performing a display operation by using the compensated display data signal.

For example, the compensated display data is provided to a data driver and then transmitted to a pixel unit of the display panel by the data driver, to control a light-emitting element in the pixel unit to emit light of corresponding intensity, thereby presenting a certain grayscale.

Technical effects of the display method of the display panel may refer to the technical effects of the compensation method provided by the embodiments of the present disclosure, and details are not described here again.

Figure 10:
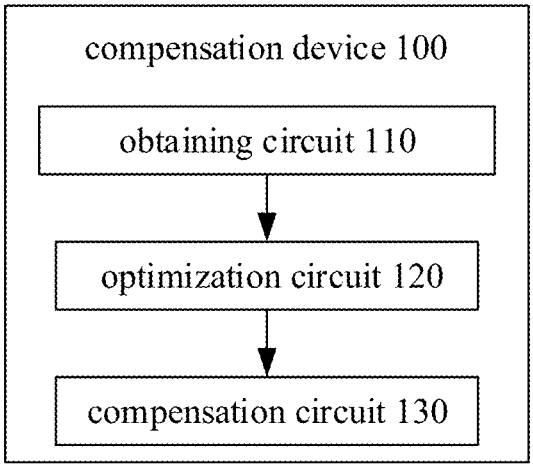
FIG. 10 is a schematic block diagram of a compensation device of a display panel provided by at least one embodiment of the present disclosure.

FIG. 10 is a schematic block diagram of a compensation device of a display panel provided by at least one embodiment of the present disclosure. As shown in FIG. 10, the compensation device 100 includes an obtaining circuit 110, an optimization circuit 120 and a compensation circuit 130.

The obtaining circuit 110 is configured to obtain an initial compensation parameter of each pixel of the display panel and an initial conversion range for performing a data conversion on the initial compensation parameter. For example, the obtaining circuit 110 may implement step S110.

The optimization circuit 120 is configured to optimize the initial conversion range based on a compensation effect of a compensation parameter obtained based on the initial conversion range, so as to obtain an optimized conversion range. For example, the optimization circuit 120 may implement step S120.

The compensation circuit 130 is configured to obtain an optimized compensation parameter of each pixel of the display panel based on the optimized conversion range. For example, the compensation circuit 130 may implement step S130.

It should be noted that, in the embodiments of the present disclosure, more or less circuits may be included, and connection relationships between the circuits are not limited, and may be determined according to actual requirements. The specific configuration of each circuit is not limited, and may be formed by an analog device according to circuit principles, or may be formed by a digital chip, or may be constructed in other suitable manners.

Figure 11:
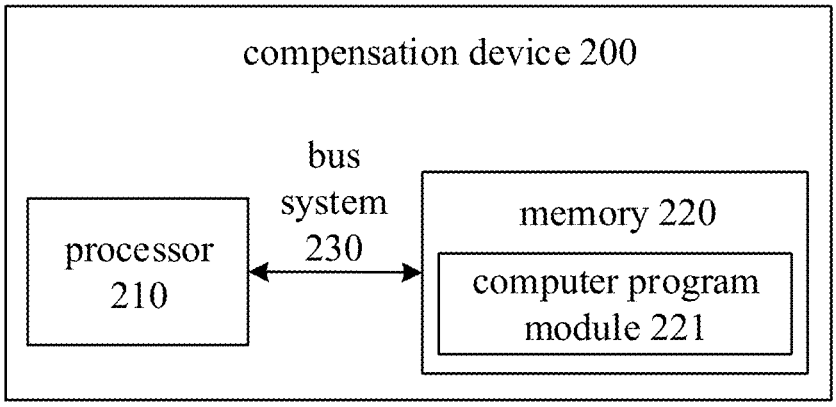
FIG. 11 is a schematic block diagram of another compensation device of a display panel provided by at least one embodiment of the present disclosure.

FIG. 11 is a schematic block diagram of another compensation device of a display panel provided by at least one embodiment of the present disclosure. As shown in FIG. 11, the compensation device 200 includes a processor 210, a memory 220 and one or more computer program modules 221.

For example, the processor 210 is connected with the memory 220 by a bus system 230. For example, the one or the plurality of computer program modules 221 may be stored in the memory 220. For example, the one or the plurality of computer program modules 221 include an instruction used for achieving the compensation method provided by any one of the embodiments of the present disclosure. For example, the instruction of the one or the plurality of computer program modules 221 may be executed by the processor 210. For example, the bus system 230 may be a conventional serial or parallel communication bus, etc., which is not limited by the embodiments of the present disclosure.

For example, the processor 210 may be a central processing unit (CPU) or other processing unit having data processing capabilities and/or instruction execution capabilities. For example, the processor 210 may be a general purpose processor or a dedicated processor, and may control other components in the compensation device 200 to achieve the expected functions. For example, the memory 220 may include one or a plurality of computer program productions, and the one or the plurality of computer program productions may include computer-readable storage mediums in various forms, such as a volatile storage and/or a non-volatile storage. The volatile storage, for example, may include a random access memory (RAM) and/or a cache memory, etc. The non-volatile storage, for example, may include a read-only memory (ROM), a hard disk, and a flash memory, etc. The one or the plurality of computer program instructions may be stored on the computer-readable storage medium, and the processor 210 may execute the one or the plurality of computer program instructions to realize the functions (realized by the processor 210) in the embodiments of the present disclosure and/or other expected functions, such as an optical compensation method, etc. Various applications and data, such as an initial conversion range and various data used and/or generated by application programs, etc., may also be stored on the computer-readable storage medium.

It should be noted that in order to be clear and concise, the present embodiment of the disclosure does not illustrate all components of the compensation device 200. Those skilled in the art may provide and arrange other components (which are not illustrated in the figures) of the compensation device 200 according to actual requirements to achieve necessary functions of the compensation device 200.

Technical effects of the compensation device 100 and the compensation device 200 in different embodiments may refer to the technical effects of the compensation method provided by the embodiments of the present disclosure, and details are not described here again.

Figure 12:
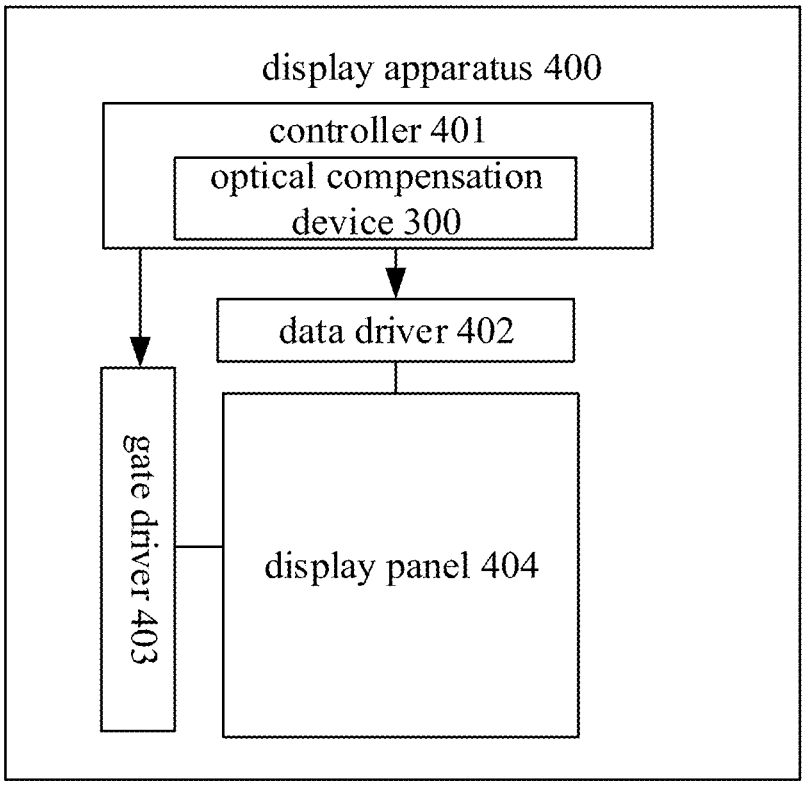
FIG. 12 is a schematic block diagram of a display apparatus provided by at least one embodiment of the present disclosure.

At least one embodiment of the present disclosure further provides a display apparatus, which includes the compensation device of a display panel provided by any one of the embodiments of the present disclosure. FIG. 12 is a schematic block diagram of a display apparatus provided by at least one embodiment of the present disclosure. As shown in FIG. 12, the display apparatus 400 includes a compensation device 300. For example, the compensation device 300 may be the compensation device 100 shown in FIG. 10 or the compensation device 200 shown in FIG. 11.

As shown in FIG. 12, the display apparatus may further include a controller 401 (for example, a timing controller T-con), a data driver 402, a gate driver 403, and a display panel 404. For example, the compensation device 300 is disposed in the controller 401, and outputs the compensated display data signal to the data driver 402 under the control of the controller 401.

For example, the display panel 404 is used to display an image. After the image data to be displayed is inputted to the display apparatus 400, the inputted display data signal is compensated by the compensation device 300, and then the display panel 404 displays images by using the compensated image data, thereby improving the display performance of the display panel, improving the display quality, and improving the display uniformity. For example, the display panel 404 may be an organic light emitting diode display panel or other type of display panel, which is not limited by the embodiments of the present disclosure.

For example, the display panel 404 includes a plurality of sub-pixels arranged in an array, and as shown in FIG. 1, each sub-pixel includes a driving circuit and a light-emitting element L1. The driving circuit includes at least a driving transistor N0 and a switching transistor T0.

For example, the gate driver 403 is configured to be connected to the switching transistor T0 through a plurality of gate lines, to provide a gate scan signal to the switching transistor T0, thereby controlling the switching transistor T0 to be turned on or off.

For example, the data driver 402 is configured to receive an output of the optical compensation device 300 in the controller 401 and then provide an image data signal to the display panel 404. The image data signal is, for example, a compensated pixel voltage (i.e., a compensated display data) for controlling a relative luminous intensity of the light-emitting element L1 of the corresponding sub-pixel in a display operation, thereby presenting a certain grayscale. The higher the voltage of the image data signal is, the larger the grayscale is, so that the relative luminous intensity of the light-emitting element L1 is larger.

For example, depending on a combination manner of various functional modules, the data driver 402 may include a digital driver and an analog driver. The analog driver receives red, green and blue (RGB) analog signals, and then outputs the RGB analog signals to the sub-pixel via a thin film transistor; and the digital driver receives the RGB digital signals, the digital signals are converted into the analog signals by a digital to analog (D/A) conversion and gamma-tuning inside the data driver, and the analog signals are outputted to sub-pixel via the thin film transistor.

For example, the data driver 402 and the gate driver 403 may be implemented by respective application specific integrated circuit chips, respectively, or may be directly prepared on the display panel 404 by a semiconductor fabrication process.

Technical effects of the display apparatus 400 provided by the above embodiment of the present disclosure may refer to the technical effects of the compensation method provided by the embodiments of the present disclosure, and details are not described here again.

At least one embodiment of the present disclosure also provides a storage medium. For example, the storage medium is used to store a computer-readable instruction non-transitorily, and in a case where the computer-readable instruction stored non-transitorily is executed by a computer (including a processor), the compensation method provided by any one of the embodiments of the present disclosure may be executed.

For example, the storage medium may be any combination of one or more computer-readable storage media. For example, a computer-readable storage medium includes computer-readable program codes used for obtaining the optimized conversion range, and another computer-readable storage medium includes computer-readable program codes used for obtaining the optimized compensation parameter of each pixel of the display panel. For example, in a case where the program code is read by the computer, the program code stored in the computer-readable storage medium is executed by the computer, and for example, an operation method, such as the compensation method, provided by any one of the embodiments of the present disclosure, is executed.

For example, the storage medium may include a memory card of a smart phone, a storage component of a tablet computer, a hard disk of a personal computer, a random access memory (RAM), a read-only memory (ROM), a erasable programmable read-only memory (EPROM), a portable compact disk read-only memory (CD-ROM), a flash memory, or any combination of the above-mentioned storage media, or other suitable storage medium.

The following should be noted:

(1) Only the structures involved in the embodiments of the present disclosure are illustrated in the drawings of the embodiments of the present disclosure, and other structures may refer to usual designs.

(2) The embodiments and features in the embodiments of the present disclosure may be combined in case of no conflict to obtain new embodiments.

The foregoing merely are exemplary embodiments of the disclosure, and not intended to define the scope of the disclosure, and the scope of the disclosure is determined by the appended claims.

What is claimed is:

1. A compensation method of a display panel, the compensation method comprising:

obtaining an initial compensation parameter of each pixel of the display panel and an initial conversion range for performing a data conversion on the initial compensation parameter;

optimizing the initial conversion range based on a compensation effect of a compensation parameter to obtain an optimized conversion range, where the compensation effect of the compensation parameter is obtained based on the initial conversion range; and obtaining an optimized compensation parameter of each pixel of the display panel based on the optimized conversion range.

2. The compensation method according to claim 1, wherein the optimizing the initial conversion range based on the compensation effect of the compensation parameter comprises:

storing the initial compensation parameter in the display panel and performing the data conversion to obtain a converted compensation parameter, based on the initial conversion range;

compensating for a display data signal of the display panel and obtaining a display compensation effect of the display panel, based on the converted compensation parameter; and optimizing, based on the display compensation effect of the display panel and the initial compensation parameter of the display panel, the initial conversion range of the initial compensation parameter to obtain the optimized conversion range.

3. The compensation method according to claim 2, wherein the optimizing, based on the display compensation effect of the display panel and the initial compensation parameter of the display panel, the initial conversion range of the initial compensation parameter comprises:

detecting, based on the obtained display compensation effect of the display panel, compensation precision and compensation strength of the display panel, and performing one of following operations:

narrowing the initial conversion range of the initial compensation parameter to obtain the optimized conversion range, in a case where the compensation precision is insufficient; or expanding the initial conversion range of the initial compensation parameter to obtain the optimized conversion range, in a case where the compensation strength is insufficient.

4. The compensation method according to claim 3, wherein, the narrowing the initial conversion range of the initial compensation parameter to obtain the optimized conversion range, in a case where the compensation precision is insufficient comprises: selecting a range smaller than the initial conversion range among a plurality of preset alternative conversion ranges; and the expanding the initial conversion range of the initial compensation parameter to obtain the optimized conversion range, in a case where the compensation strength is insufficient comprises: selecting a range greater than the initial conversion range among a plurality of preset alternative conversion ranges.

5. The compensation method according to claim 4, wherein the display panel comprises a plurality of display regions, the plurality of display regions comprises a first display region, the initial compensation parameter comprises a first initial compensation parameter corresponding to the first display region, the initial conversion range comprises a first initial conversion range corresponding to the first display region, and the compensation method optimizes the first initial conversion range of the first display region, based on the first initial compensation parameter and a display compensation effect of the first display region.

6. The compensation method according to claim 3, wherein the initial compensation parameter of each pixel is in at least one selected from a group consisting of: the initial conversion range and the optimized conversion range.

7. The compensation method according to claim 6, wherein the display panel comprises a plurality of display regions, the plurality of display regions comprises a first display region, the initial compensation parameter comprises a first initial compensation parameter corresponding to the first display region, the initial conversion range comprises a first initial conversion range corresponding to the first display region, and the compensation method optimizes the first initial conversion range of the first display region, based on the first initial compensation parameter and a display compensation effect of the first display region.

8. The compensation method according to claim 3, wherein the display panel comprises a plurality of display regions, the plurality of display regions comprises a first display region, the initial compensation parameter comprises a first initial compensation parameter corresponding to the first display region, the initial conversion range comprises a first initial conversion range corresponding to the first display region, and the compensation method optimizes the first initial conversion range of the first display region, based on the first initial compensation parameter and a display compensation effect of the first display region.

9. The compensation method according to claim 2, wherein the display panel comprises a plurality of display regions, the plurality of display regions comprises a first display region, the initial compensation parameter comprises a first initial compensation parameter corresponding to the first display region, the initial conversion range comprises a first initial conversion range corresponding to the first display region, and the compensation method optimizes the first initial conversion range of the first display region, based on the first initial compensation parameter and a display compensation effect of the first display region.

10. The compensation method according to claim 1, further comprising: storing the optimized compensation parameter of each pixel in the display panel to compensate for a display data signal of the display panel by the display panel based on the optimized compensation parameter in a display operation.

11. The compensation method according to claim 10, wherein the optimized compensation parameter of each pixel is stored in a lookup table of a controller of the display panel, and the display panel obtains from the lookup table an optimized compensation parameter corresponding to a current pixel in the display operation to obtain a display compensation data of the current pixel.

12. The compensation method according to claim 1, wherein the display panel comprises a plurality of display regions, the plurality of display regions comprises a first display region, the initial compensation parameter comprises a first initial compensation parameter corresponding to the first display region, the initial conversion range comprises a first initial conversion range corresponding to the first display region, and the compensation method optimizes the first initial conversion range of the first display region, based on the first initial compensation parameter and a display compensation effect of the first display region.

13. The compensation method according to claim 12, wherein the plurality of display regions further comprises a second display region different from the first display region, the initial compensation parameter comprises a second initial compensation parameter corresponding to the second display region, the initial conversion range comprises a second initial conversion range corresponding to the second display region, and the compensation method further optimizes the second initial conversion range of the second display region based on the second initial compensation parameter and a display compensation effect of the second display region.

14. A compensation device of a display panel, the compensation device comprising:

a processor;

a memory; and one or more computer program modules, wherein the one or more computer program modules are stored in the memory and are configured to be executed by the processor, and the one or more computer program modules comprise an instruction used for achieving the compensation method of a display panel according to claim 1.

15. A display apparatus, comprising the compensation device of a display panel according to claim 14.

16. The compensation method according to claim 1, wherein the initial compensation parameter of each pixel of the display panel is a compensation parameter obtained based on obtained optical data of the display panel.

17. A display method of a display panel, the display method comprising:

obtaining an optimized conversion range and an optimized compensation parameter of the display panel by the compensation method according to claim 1;

compensating for a display data signal of the display panel based on the optimized compensation parameter; and performing a display operation by using the compensated display data signal.

18. A non-transitory computer storage medium, storing a computer-readable instruction, which, when executed by a processing device, causes the compensation method of a display panel according to claim 1 to be performed.

19. A compensation device of a display panel, the compensation device comprising:

an obtaining circuit, configured to obtain an initial compensation parameter of each pixel of the display panel and an initial conversion range for performing a data conversion on the initial compensation parameter;

an optimization circuit, configured to optimize the initial conversion range based on a compensation effect of a compensation parameter obtained based on the initial conversion range, to obtain an optimized conversion range; and a compensation circuit, configured to obtain an optimized compensation parameter of each pixel of the display panel based on the optimized conversion range.

20. A display apparatus, comprising the compensation device of a display panel according to claim 19.

* * * * *